US005775143A

United States Patent [19]

Mauer

[11] Patent Number: 5,775,143

[45] Date of Patent: Jul. 7, 1998

[54] RESETTABLE DOUBLE-BIT LOCK

[75] Inventor: Gunter Mauer, Heiligenhaus, Germany

[73] Assignee: Mauer GmbH, Heiligenhaus, Germany

[21] Appl. No.: 743,103

[22] Filed: Nov. 4, 1996

[30] Foreign Application Priority Data

Nov. 11, 1995 [DE] Germany ..... 195 42 113.2

[51] Int. Cl.[6] ..... E05B 21/00

[52] U.S. Cl. ..... 70/355; 70/383

[58] Field of Search ..... 70/312, 315, 317, 70/337–340, 377, 382–384, 353–355

[56] References Cited

U.S. PATENT DOCUMENTS

| | | | |
|---|---|---|---|
| 690,537 | 1/1902 | Taylor | 70/384 |
| 1,693,731 | 12/1928 | Sioberg | 70/383 |
| 3,772,904 | 11/1973 | Parrock | 70/383 X |
| 3,983,728 | 10/1976 | Phillips | 70/383 X |
| 4,072,032 | 2/1978 | Phillips | 70/383 X |
| 4,516,417 | 5/1985 | Parrock | 70/384 |
| 4,526,022 | 7/1985 | Parrock | 70/384 X |
| 4,580,424 | 4/1986 | Evans | 70/383 |
| 4,602,491 | 7/1986 | Mauer | 70/317 X |
| 4,907,431 | 3/1990 | Mauer | 70/384 X |
| 5,502,990 | 4/1996 | Hirvi | 70/383 |

*Primary Examiner*—Suzanne Dino Barrett
*Attorney, Agent, or Firm*—Edwin D. Schindler

[57] ABSTRACT

A resettable double-bit lock is disclosed, with a bolt having a resetting blade and a plurality of studded disks supported therein. The studded disks are adjacent a plurality of tumblers, the tumblers being supported pivotally around a mandrel and arranged by a double-bit key. A resetting swivel is supported on the bottom surface of the housing for the lock, with the resetting swivel being actuated by a bit of a resetting key and displacing thereby a resetting lock device. The resetting lock device includes a nose which releases a locking angle, the latter of which folding over into an opening position under a biassing force, which is preferably created by a spring. The locking angle further includes an arm so that when the bolt of the lock is pulled backwards, the resetting blade runs against the arm of the locking angle and releases the plurality of studded disks contained within the resetting blade.

3 Claims, 4 Drawing Sheets

RESETTABLE DOUBLE-BIT LOCK

BACKGROUND OF THE INVENTION

1. Technical Field of the Invention

The present invention relates to a resettable double-bit lock having a bolt, in which a resetting blade and a package of studded disks are supported. The studded disks are faced by a package of tumblers, which are pivotably supported around a mandrel.

2. Description of the Prior Art

In connection with resettable double-bit locks known to the prior art, the lock is able to be reset from the back thereof. The lock is opened with a previously used key, then a door is opened and a resetting lever projecting from the rear wall of the lock is actuated; the lever lifting a resetting blade outward. Subsequently, the key is pulled out and a differently coded key is inserted. After turning the key, and the new arrangement of the coding, the studded disks are blocked once again by the resetting blade. This completes the resetting.

It is recognized as a drawback by the prior art that the cabinet door has to be opened for the resetting procedure. Generally, in connection with cabinets having two locks, it is tedious and time-consuming that the person having authorization for the second lock has to be present.

SUMMARY OF THE INVENTION

It is an object of the present invention to provide a resettable double-bit lock whereby the lock can be reset from the front side of the lock via the keyhole.

It is a further object of the present invention to provide a resettable double-bit lock which overcomes the drawbacks inherent in prior art locks of the type with which the present invention is concerned.

The foregoing and related objects are accomplished by the resettable double-bit lock of the present invention, which is provided with a bolt having a resetting blade and a plurality of studded disks supported therein. The studded disks are adjacent a plurality of tumblers, the tumblers being supported pivotally around a mandrel and arranged by a double-bit key. A resetting swivel is supported on the bottom surface of the housing for the lock, with the resetting swivel being actuated by a bit of a resetting key and displacing thereby a resetting lock device. The resetting lock device includes a nose which releases a locking angle, the latter of which folding over into an opening position under a biassing force, which is preferably created by a spring. The locking angle further includes an arm so that when the bolt of the lock is pulled backwards, the resetting blade runs against the arm of the locking angle and releases the plurality of studded disks contained within the resetting blade.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views.

DETAILED DESCRIPTION OF THE DRAWING FIGURES AND PREFERRED EMBODIMENTS

Figure 1A:
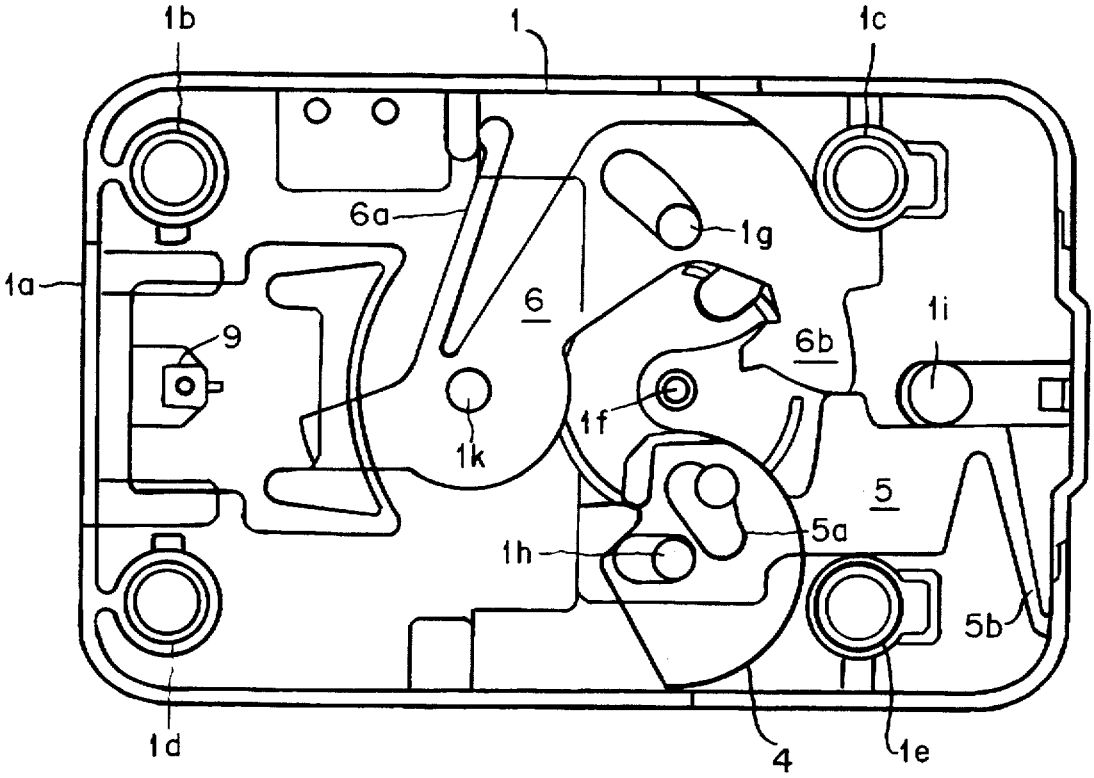
FIG. 1 shows the components of the resettable double-bit lock of the present invention, which serve for resetting the lock with the resetting device locked.

Turning now, in detail, to an analysis of the drawing figures, in FIG. 1*a*, reference numeral 1 denotes the housing of the double-bit lock of the invention, with illustration given of only those components which are disposed beneath the removed bolt 2 (see, FIG. 1*b*) and which serve for resetting the lock combination. On the left face side, housing 1 has a rectangular opening 1*a*, from which the bolt head 2*a* exits. The four hollow columns 1*b*, 1*c*, 1*d*, 1*e* project from the bottom of the lock housing; said hollow columns serving for receiving fastening screws. The key guide mandrel is denoted by reference numeral 1*f*. Additional guide mandrels 1*g*, 1*h* prevent bolt 2 from performing tilting movements. The associated slots in bolt 2 are denoted by reference numerals 2*b*, 2*c*.

A supporting mandrel 1*i* receives the tumbler package 3, which rests on the bottom surface 2*d* of bolt 2.

Figure 5:
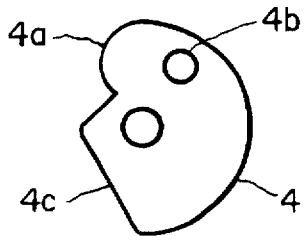
FIG. 5 shows the resetting swivel of the resettable double-bit lock of FIG. 1.
Figure 7:
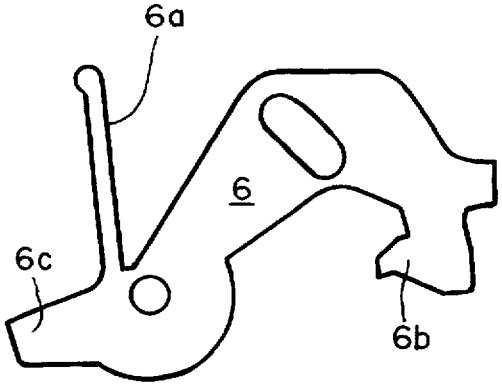
FIG. 7 shows the locking angle of the resettable double-bit lock of FIG. 1; and, FIG. 8 shows the resetting blade of the resettable double-bit lock of FIG. 1.
Figure 6:
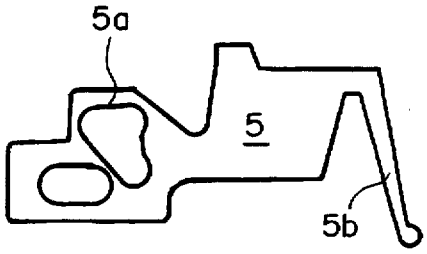
FIG. 6 shows the resetting lock device of the resettable double-bit lock of FIG. 1.

The components serving for resetting are a resetting swivel 4, a resetting lock device 5, and a locking angle 6, which components are shown enlarged in FIGS. 5–7.

Figure 2A:
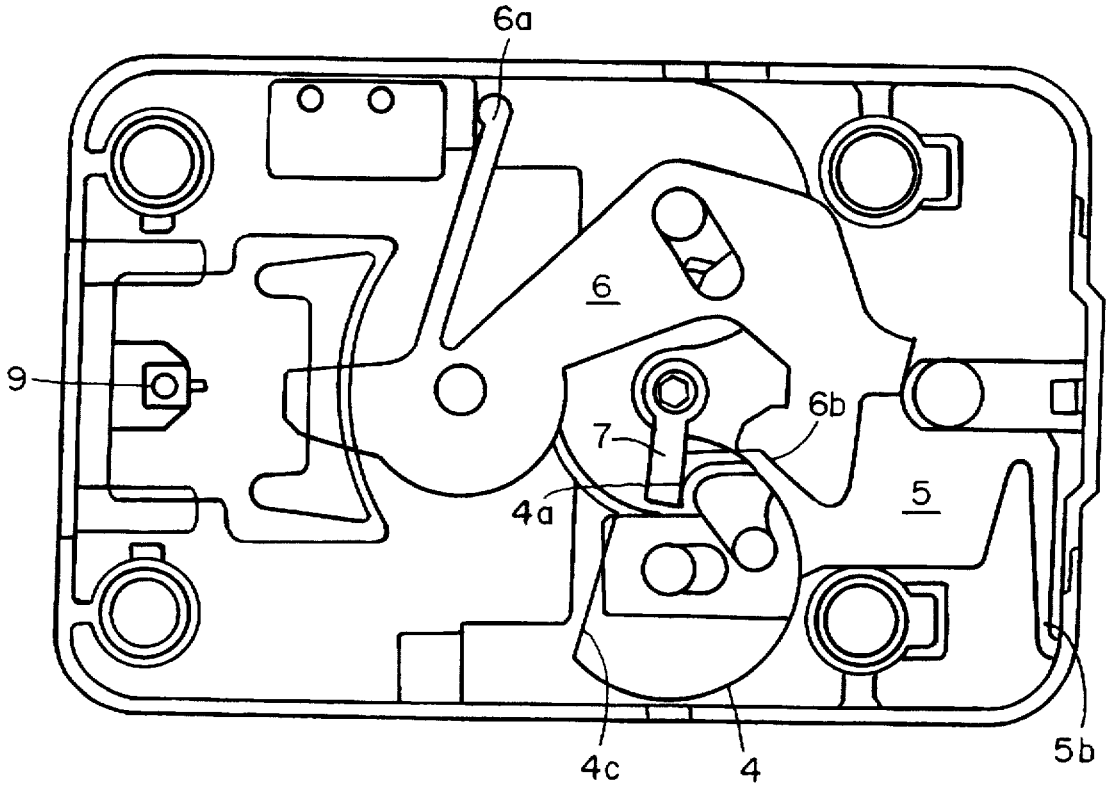
FIG. 2 shows the components of FIG. 1 after a resetting key has been inserted in the keyhole and turned in a leftward direction.
Figure 2B:
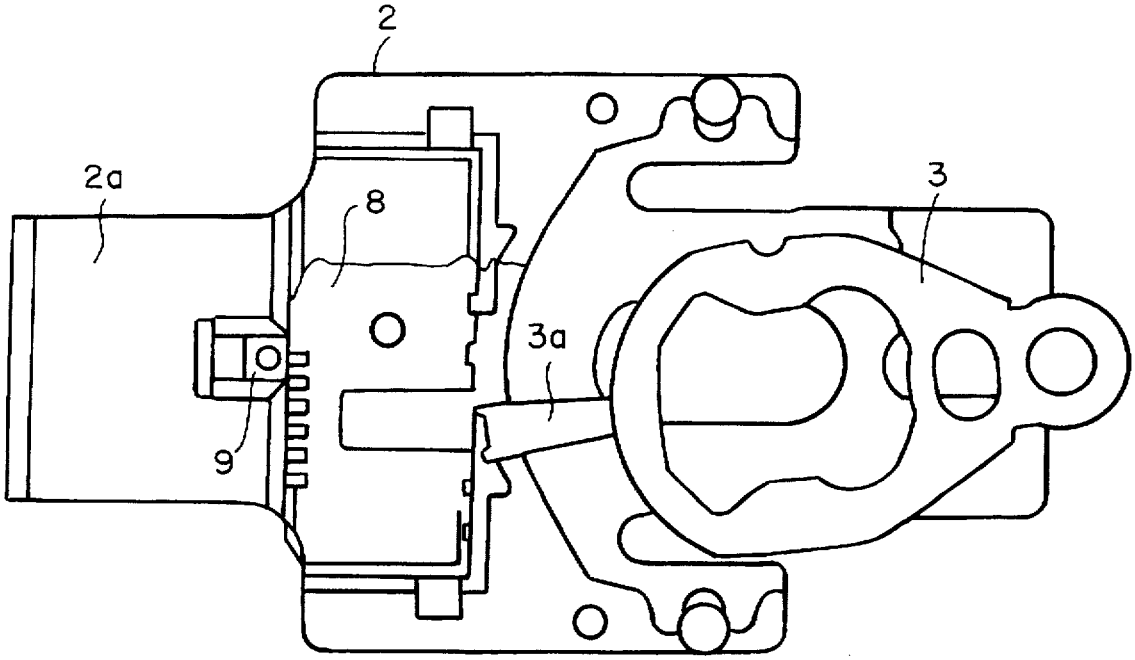

The resetting swivel 4 is supported on guide mandrel 1*h*. Resetting swivel 4 has a control cam 4*a*, which is actuated by the bit 7 of a resetting key (shown in FIG. 2*a*.) The resetting swivel 4, additionally, supports a control mandrel 4*b*; the latter sliding in a control recess 5*a* of resetting lock device 5. The latter is displaceably supported and supports a spring 5*b* shaped on it by molding. In the position illustrated in FIG. 1*a*, a nose 6*b* prevents locking angle 6 from swiveling to the right. Locking angle 6 is supported on a mandrel 1*k*. A molded spring 6*a* causes locking angle 6 to swing to the right when the resetting lock device 5 assumes its right-hand final position, as illustrated in FIG. 2*a*.

Figure 1B:
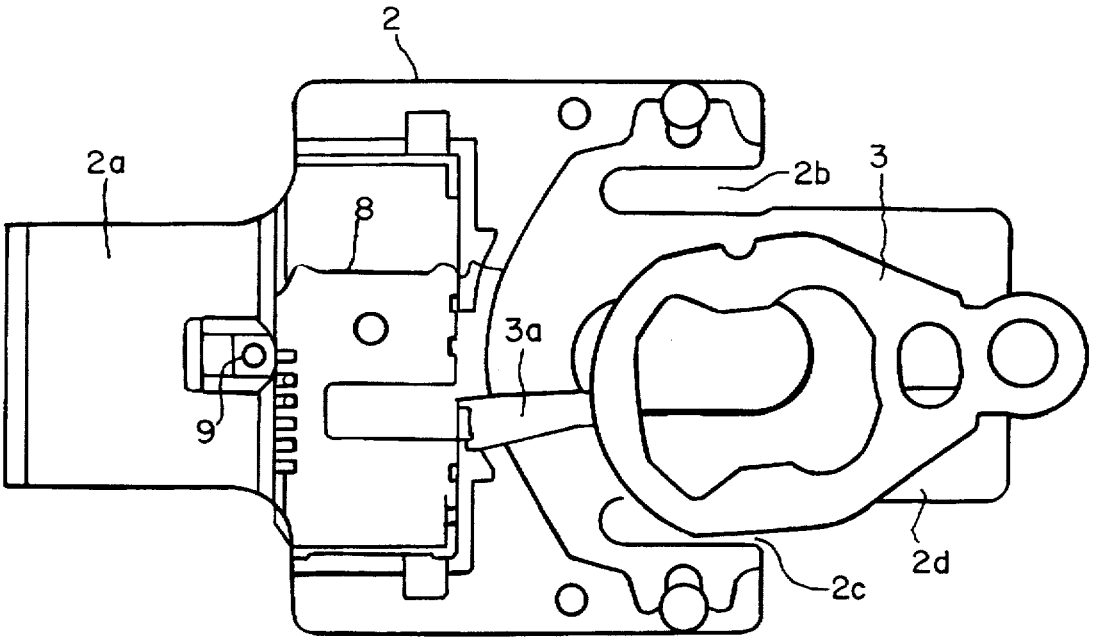

As can be seen from FIG. 1*b*, tumbler package 3 is faced by a studded disk package 8, which is displaceably supported in bolt 2. A resetting blade 9 engages the toothing of the studding disks and arrests the selected coding.

Figure 3A:
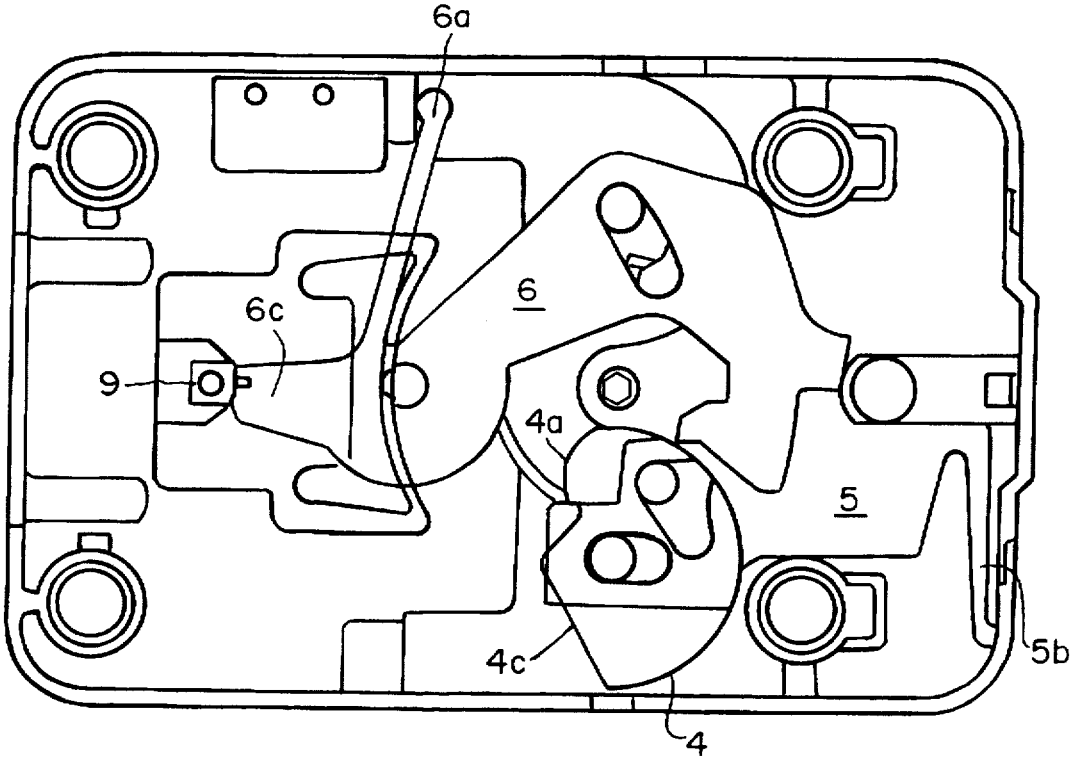
FIG. 3 shows the unlocking of the studded disks occurring when the lock bolt is pulled in a backwards direction.
Figure 3B:
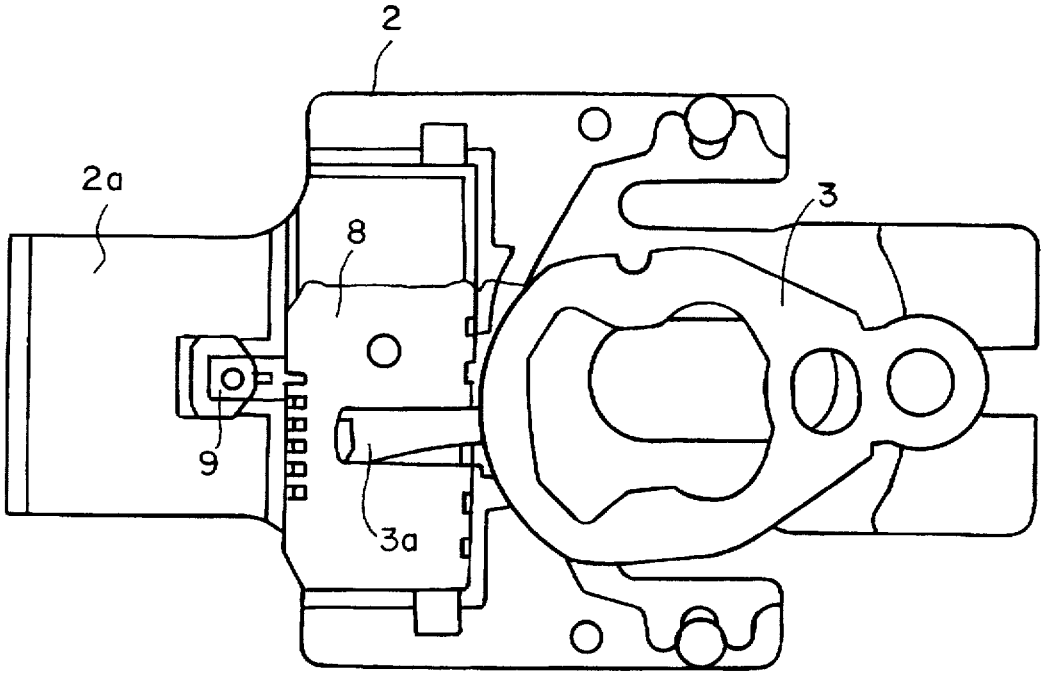

When the matching key is inserted in the lock and turned clockwise, the tumblers are correctly arranged, so that their tongues 3*a* are capable of engaging the slots of the studded disks, as shown in FIG. 3*b*.

Component parts 4, 5, 6 are not reset during the normal operation of the lock.

The key can be turned by only about 135° because its bit hits against the nose 6*b* of locking angle 6. Therefore, the key cannot be pulled out when bolt 2 is in a pulled-back position.

The resetting process takes place as follows:

The resetting key is inserted with the door closed, thus with the bolt extended, and its bit 7 is turned by 90° to the left in order to bring the resetting swivel 4 from the locking position, according to FIG. 1*a*, into the resetting position, as illustrated in FIG. 2*a*. The reset lock device 5 is, at the same time, pushed to the right via the control mandrel 4*b*, so that the locking angle 6, as well, can fold over and into the resetting position, in accordance with FIG. 2*a*.

Figure 4:
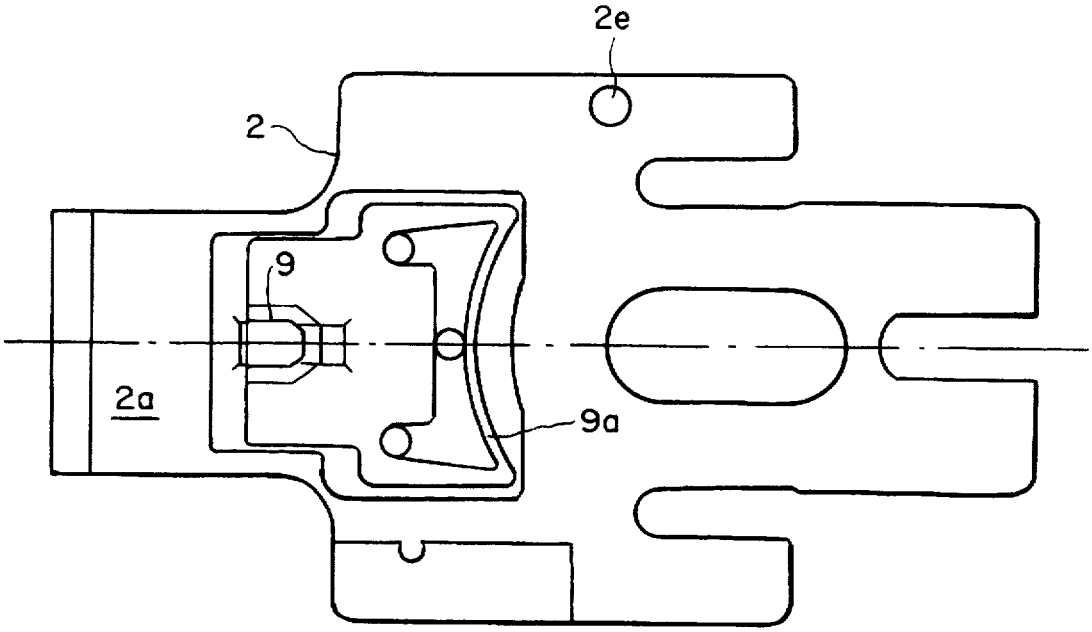
FIG. 4 shows the underside of the lock bolt of the resettable double-bit lock of FIG. 1.

The resetting key is now turned to the right by 90° and pulled out. The fitting double-bit key is inserted and turned to the right by 180°. The previously valid key is now pulled outward while bolt 2 is retracted and replaced by a new key that can be coded in any desired manner. The new key then has to be inserted into the keyhole in the 180°-position. When the lock is opened, with its locking angle being in the resetting position according to FIG. 3*a*, the left arm 6*c* of the locking angle hits against the resetting blade 9, which, according to FIG. 4, is elastically supported on the underside of bolt 2 with the assistance of a frame 9*a*. This causes the resetting blade 9 to be lifted from the teeth of the studded disks 8, as is clearly shown in FIG. 3*b*.

Additionally, a mandrel 2*e* hits upon the underside of bolt 2 against surface 4*c* of the resetting swivel 4 and swivels the latter backwards into the locking position, in the manner shown in FIG. 3*a*.

When the new key is now turned leftward, it rearranges tumblers 3 and the studded disks 8, coupled therewith, while bolt 2 is being driven out. In addition, the key bit forces the locking angle 6 into a left turn, so that the locked condition, according to FIG. 1*a*, is reestablished. Due to the spring action of frame 9*a*, the resetting blade 9 locks in the toothing of the studded disk package 8.

When the lock is opened again the next time, the key remains caught again in the keyhole because its bit is stopped by nose 6*b*.

The entire resetting process takes place without having to open the door of the locking device.

FIGS. 5–8 show, again, the elements of the invention which participate in the resetting process.

FIG. 5 shows resetting swivel 4, with a control cam 4*a*, a mandrel 4*b*, and a surface 4*c*.

FIG. 6 shows the reset lock device 5, with the control recess 5*a* and the spring 5*b*, shaped by molding.

FIG. 7 shows the shape of locking angle 6, which has a spring 6*a* shaped upon it by molding, a nose 6*b* and an arm 6*c*.

Figure 8:
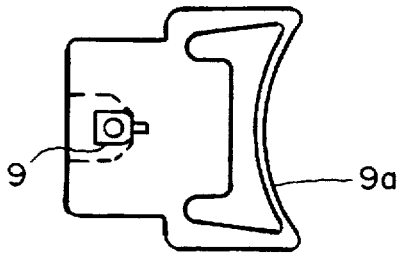

Resetting blade 9, with an elastic frame 9*a*, can be seen in FIG. 8.

Component parts 4, 5, 6, 7 and 9 are, preferably, made of a dimensionally stable, tough and elastic plastic.

While only several embodiments of the present invention have been shown and described, it will be obvious to those skilled in the art that many modifications may be made to the present invention without departing from the spirit and scope thereof.

LIST OF REFERENCE NUMERALS

| | |
|---|---|
| 1 | lock housing |
| 1a | opening |
| 1b, 1c, 1d, 1e | hollow columns |
| 1f | key guide mandrel |
| 1g, 1h | guide mandrels |
| 1i | supporting mandrel |
| 2 | bolt |
| 2a | bolt head |
| 2b, 2c | slots |
| 2d | bottom surface |
| 2e | mandrel |
| 3 | tumbler package |
| 3a | tongues |
| 4 | resetting swivel |
| 4a | control cam |
| 4b | control mandrel |
| 5 | reset lock device |
| 5a | control recess |
| 5b | spring |
| 6 | locking angle |
| 6a | molded spring |
| 6b | nose |
| 6c | arm |
| 7 | bit of a resetting key |
| 8 | studded disk package |
| 9 | resetting blade |
| 9a | frame |

What is claimed is:

1. A resettable double-bit lock, comprising:

a housing;

a bolt having a resetting blade;

a mandrel;

a plurality of tumblers being pivotally supported around said mandrel and arranged by a double-bit key;

a plurality of studded disks supported within said resetting blade, said plurality of studded disks being faced by said plurality of tumblers;

a resetting swivel being supported on a bottom surface of said housing;

a keyhole for a resetting key located on a front side of said housing; and, a reset lock device having a nose for releasing a locking angle having an arm, said locking angle swinging into an opening position under a biassing force, so that when said bolt is pulled backward, said resetting blade runs against said arm of said locking angle and releases said plurality of studded disks, said resetting swivel being actuated by a bit of the resetting key via said keyhole, thereby displacing said reset lock device.

2. The resettable double-bit lock according to claim 1, further comprising a supporting mandrel supported on a bottom surface of said bolt, said supporting mandrel pulling backward said resetting swivel so that a new key is capable of resetting said locking angle when turned back for a new programming of said plurality of studded disks.

3. The resettable double-bit lock according to claim 2, wherein said nose of said locking angle is structured for limiting movement of a key for preventing the key from being pulled outwards when a door of said lock is opened.

* * * * *